United States Patent [19]

Iwadachi

[11] Patent Number: 4,935,202

[45] Date of Patent: Jun. 19, 1990

[54] ELECTRICALLY CONDUCTIVE SPRING MATERIALS

[75] Inventor: Takaharu Iwadachi, Handa City, Japan

[73] Assignee: NGK Insulators, Ltd., Japan

[21] Appl. No.: 263,002

[22] Filed: Oct. 27, 1988

[30] Foreign Application Priority Data

Oct. 30, 1987 [JP] Japan ..... 62-276919

[51] Int. Cl.[5] ..... C22C 9/06

[52] U.S. Cl. ..... 420/486; 420/494

[58] Field of Search ..... 420/485, 486, 489, 494, 420/496

[56] References Cited

U.S. PATENT DOCUMENTS 2,027,750 1/1936 Munson ..... 420/486
4,666,667 5/1987 Kamio et al. ..... 420/494
4,792,365 12/1988 Matsui et al. ..... 248/12.7 C

FOREIGN PATENT DOCUMENTS 59-145745 8/1984 Japan .
60-245754 12/1985 Japan .
61-064839 4/1986 Japan .
61-143566 7/1986 Japan .
58-141352 8/1988 Japan .

OTHER PUBLICATIONS

No. JP-A-61 183 426 date: 8/16/86 Japan (VI).
No. JP-A-62 083 441 date: 4/16/87 Japan (VII).
No. JP-A-62 083 442 date: 4/16/87 Japan (VIII).

*Primary Examiner*—R. Dean
*Assistant Examiner*—David W. Schumaker
*Attorney, Agent, or Firm*—Arnold, White & Durkee

[57] ABSTRACT

An electrically conductive material including 0.15% to 0.35% of Be, 0.3% to 1.5% of Al, either one or both of Ni and Co in a total amount of 1.6% to 3.5%, in terms of weight, and the balance being Cu with inevitable impurities. The alloy may further contain at least one of Si, Sn, Zn, Fe, Mg and Ti in a total amount of 0.05% to 1.0%, in terms of weight ratio. Each of the Si, Sn, Zn, Fe, Mg and Ti is in an amount of 0.05% to 0.35%.

4 Claims, 1 Drawing Sheet

ELECTRICALLY CONDUCTIVE SPRING MATERIALS

BACKGROUND OF THE INVENTION (1) Field of the Invention

The present invention relates to electrically conductive spring materials having excellent electrical conductivity and spring properties for use as materials for electrical parts such as connectors, switches, relays, and the like. (2) Related Art Statement Although phosphor bronze has been used as electrically conductive materials for a long time, it has insufficient strength, electrical conductivity, bending formability, and stress relaxation property, when used as compact electronic parts which required high reliability. Therefore, So, Cu-Ni-Be base alloys having a nominal composition of Cu-0.4% Be-1.8% Ni have attracted public attention. However, such alloys unfavorably have high material costs and unsatisfactory stress relaxation property.

Further, it has been known that additions of Al to Cu-Ni-Be base ternary alloys is effective for improving strength. For instance, Japanese patent application Laid-open No. 48-103,023 discloses spring alloys containing 0.3 to 1.0% of Be, 1.0 to 3.0% of Ni, and 2.0 to 7.0% of Al as fundamental ingredients. However, since such spring alloys contain not less than 2.0% of Al, they have other shortcomings in that the alloys have poor rollability and high production costs, and that electrical conductivity and bending formability are damaged with Al.

SUMMARY OF THE INVENTION

The object of the present invention is to solve the conventional problems mentioned above, and has been accomplished to provide electrically conductive spring materials having more excellent electrical conductivity, bending formability, stress relaxation property, and rollability as well as lower production costs as compared with conventional phosphor bronze, Cu-Ni-Be based alloys, and Cu-Ni-Al-Be based alloys.

According to a first aspect of the invention, there is a provision of an electrically conductive spring material consisting essentially of 0.15 to 0.35% of Be, 0.3 to 1.5% of Al, either one or both of Ni and Co in a total amount of 1.6 to 3.5% in terms of weight, and the balance being Cu with inevitable impurities.

According to a second aspect of the present invention, there is a provision of an electrically conductive spring material consisting essentially of 0.15 to 0.35% of Be, 0.3 to 1.5% of Al, either one or both of Ni and Co in a total amount of 1.6 to 3.5%, at least one of Si, Sn, Zn, Fe, Mg and Ti in a total amount of 0.05 to 1.0%, each of Si, Sn, Zn, Fe, Mg and Ti being in an amount of 0.05 to 0.35%, in terms of weight, the balance being Cu with inevitable impurities.

As mentioned above, according to the invention, the content of Be is suppressed to a low level of 0.15 to 0.35% as compared with the conventional alloys. This is to reduce the material cost. However, if Be is reduced, strength tends to drop due to growth of crystalline grains during solution treatment. In Japanese patent application Laid-open No. 48-103,023 referred to above, it has been attempted to reduce the decrease in strength due to reduction of Be down to 0.3% by adding a great addition amount of Al in a range from 2 to 7%. Consequently, rollability becomes poor and production costs increase. Thus, it is feared that the total cost increases to the contrary.

On the other hand, according to the present invention, strength reduction due to a decrease in Be is complemented by relatively increasing Ni and/or Co with the addition of a small amount of Al. Thus, in the present invention, coarsening of crystalline grains during the solution treatment, which is promoted by the addition of Al, is effectively controlled by optimizing the content of Ni and/or Co and the relative ratio between Al+Be and Ni+Co, thereby improving formability. Further, when Al is in a range from 0.3 to 1.5%, stress relaxation is improved, and rollability is not damaged without increasing production costs. The above combination of a small amount of Be in a range from 0.15 to 0.35%, a smaller amount of Al in a range from 0.3 to 1.5% as compared with that of the conventional alloys, and 1.6 to 3.5% of Ni and/or Co in the first aspect of the present invention is first proposed by the present invention. Thus, the object of the present invention is to provide Cu-Be based alloys having more excellent total balance as compared with that of the conventional alloys added with a greater amount of Al.

Further, according to the second aspect of the present invention, mechanical strength is further improved by adding at least one element selected, from the group consisting of Si, Sn, Zn, Fe, Mg and Ti to the alloy composition in the first aspect. No effect is obtained if each of the elements is less than 0.05%. To the contrary, if each of them exceeds 0.35% or if the total amount is more than 1.0%, the effect is not only saturated, but also electrical conductivity is lowered.

These and other objects, features and advantages of the invention will be appreciated upon reading the following description of the invention when taken in conjunction with the attached drawings, with the understanding that some modifications, variations, and changes of the same could be made by the skilled person in the art to which the invention pertains without departing from the spirit of the invention or the scope of claims appended hereto.

BRIEF DESCRIPTION OF THE ATTACHED DRAWING

For a better understanding of the invention, reference is made to the attached drawings, wherein:

FIG. 1 is a graph showing the relationship between the content of Al and that of Ni+Co; and FIG. 2 is a graph showing the relationship between the content of Be and that of Ni+Co.

DETAILED DESCRIPTION OF THE

Figure 1:
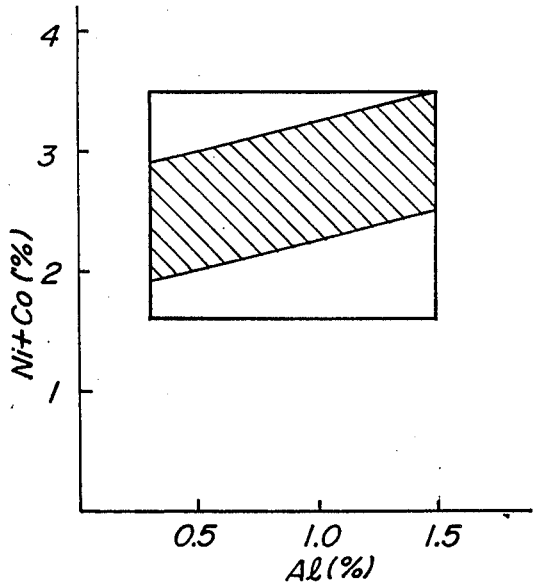

First, the reasons for the limitation of the respective ingredients of the alloys according to the present invention will be explained below.

In the following, "%" means "% by weight" unless otherwise specified.

If Be is less than 0.15%, strength is lowered due to decreased precipitation hardenability, and coarsening of crystalline grains cannot be prevented during solution treatment. To the contrary, if Be is more than 0.35%, the cost of the materials cannot be reduced. Thus, Be is set in a range from 0.15 to 0.35%.

Al is an important element to complement strength reduction due to the decreased amount of Be and particularly to improve stress relaxation property. If Al is less than 0.3%, its effect is not noticeable. To the contrary, if it is more than 1.5%, electrical conductivity is extremely damaged, and production costs become higher due to damaged rollability. Thus, Al is set in a range from 0.3 to 1.5%, preferably from 0.4 to 1.1%. When Al is added in an amount from 0.3 to 1.5%, castability of the alloys, separability of slag, oxidation resistance, etc. are greatly improved, and the production cost is reduced.

If the total amount of Ni and Co is less than 1.6%, the crystalline grains cannot be prevented from becoming coarsening during the solution treatment due to reduced Be and added Al. Consequently, strength, elongation, or formability cannot be improved. On the other hand, if the total amount of Ni and Co is more than 3.5%, there arises problems in that strength is reduced, electrical conductivity becomes lower, and castability and hot processability of the materials are damaged. Thus, the total amount of Ni and Co is set in a range from 1.6 to 3.5%, preferably from 2.0 to 2.7%.

The relationships between the total amount of Ni and Co and the content of Al or the content of Be have been examined in detail. As a result, it was found that the most preferable characteristics can be obtained when they satisfy the following inequalities (1) and (2) in terms of weight ratio.

$$(1.75 + 0.5 \times \text{Al content}) \leqq (\text{Ni content} + \text{Co content}) \leqq (2.75 + 0.5 \times \text{Al content}) \quad (1)$$

$$(2.4 - 2 \times \text{Be content}) \leqq (\text{Ni content} + \text{Co content}) \leqq (3.6 - 2 \times \text{Be content}) \quad (2)$$

Figure 2:
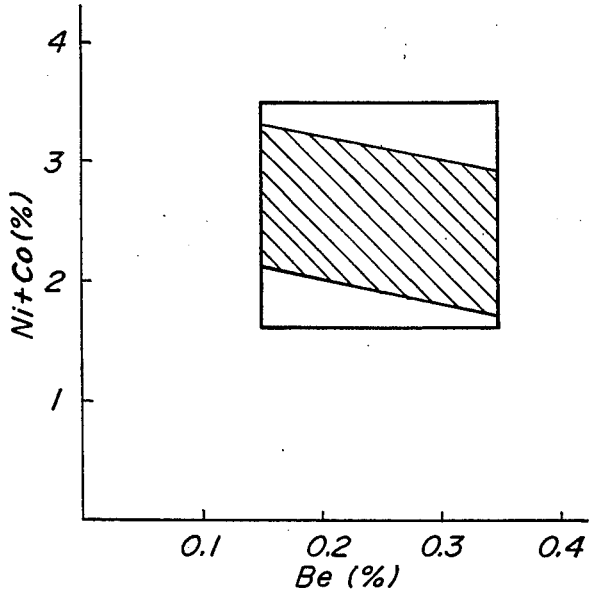

These relationships are shown as shadowed portions in the graphs of FIGS. 1 and 2, respectively. In order to offset the influences such as coarsening of the crystalline grains due to increased Al during the solution treatment, as is seen from FIGS. 1 and 2, the content of (Ni+Co) must be increased with an increase in Al. Further, when the content of Be decreases, that of (Ni+Co) must be increased.

Next, the second aspect of the present invention will be explained.

In the second aspect of the present invention, mechanical strength is improved by further adding at least one element selected from the group consisting of Si, Sn, Zn, Fe, Mg and Ti to the alloy composition in the first aspect of the present invention. If each of the elements is less than 0.05%, no effect is recognized. On the other hand, if each of them is more than 0.35% or if the total content thereof is more than 1.0%, the effect is not only saturated, but also electrical conductivity is lowered.

The alloys according to the first and second aspects of the present invention have equivalent or more excellent spring characteristics as compared with spring phosphor bronze, have particularly excellent stress relaxation property, electrical conductivity, and formability, and are excellent in terms of costs.

Next, characteristic values of the alloys according to the present invention will be given with reference to the following specific examples below.

EXPERIMENT 1

Alloy Nos. 1-(Nos. 1-8: alloys of the first aspect of the present invention, Nos. 9-14: alloys of the second aspect of the present invention) and Comparative alloys Nos. 1-10 having respective compositions given in Table 1 were each melted and cast in a high frequency wave induction furnace, hot forged, hot rolled, and repeatedly annealed and rolled, thereby obtaining alloy sheets of 0.34 mm in thickness. Next, each of the sheets was heated at 930° C. for 5 minutes and cooled in water as a final solution treatment, rolled at a draft of 40%, and aged at 450° C. for 2 hours. Various characteristics were then measured. Results are shown in Table 2. Comparative Example 10 was an alloy having a nominal composition of Cu-0.4% Be-1.8%Ni, and Comparative alloy No. 11 was a commercially available spring phosphor bronze.

The stress relaxation property was determined by applying a maximum bending stress of 40 kgf/mm$^2$ to a test piece, releasing a bending load by maintaining it at 200° C. for 100 hours, measuring a perpetually deformed amount, and converting the deformed amount to a stress residual percentage.

The bending formability was evaluated by the ratio of R/t in which R and t were the minimum radium causing no cracks when the test piece was bent, and the thickness of the test piece, respectively.

The above characteristics were examined with respect to a longitudinal direction and a transverse direction to a rolling direction.

EXPERIMENT 2

Specimens having a thickness of 0.22 mm were obtained by processing each of the alloy Nos. 1-14 and Comparative alloy Nos. 1-10 in the same manner as in Experiment 1. The specimens were then subjected to the final solution treatment at 930° C. for 5 minutes, rolling at a draft of 10%, and aging at 450° C. for 2 hours thereby obtaining. Various characteristics were measured. Results are shown in Table 3. Evaluations were carried out in the same manner as in Experiment 1.

EXPERIMENT 3

Specimens having a thickness of 2.0 mm in thickness was obtained by processing Example alloy Nos. 1-14 and Comparative alloy Nos. 1-10 in Table 1 in the same manner as in Experiment 1. The specimens were then subjected to the final solution treatment at 930° C. for 5 hours, rolling at a draft of 90%, and aging at 400° C. for 4 hours. Various characteristics were then measured. Results are shown in Table 4.

TABLE 1(a)

| | Alloy composition | | | | | |
|---|---|---|---|---|---|---|
| | Be | Ni | Co | Al | Other elements | Cu |
| Example 1 | 0.15 | — | 1.80 | 0.35 | — | balance |
| Example 2 | 0.17 | 2.9 | — | 0.70 | — | balance |
| Example 3 | 0.18 | 2.20 | 0.25 | 0.78 | — | balance |
| Example 4 | 0.20 | 2.45 | — | 0.85 | — | balance |
| Example 5 | 0.25 | 1.85 | — | 0.60 | — | balance |
| Example 6 | 0.27 | 0.32 | 2.50 | 1.46 | — | balance |
| Example 7 | 0.24 | — | 2.70 | 0.46 | — | balance |
| Example 8 | 0.25 | 3.05 | — | 0.95 | — | balance |
| Example 9 | 0.23 | 2.30 | — | 0.82 | Si:0.20 | balance |
| Example 10 | 0.28 | 2.56 | 0.10 | 0.40 | Sn:0.30 | balance |
| Example 11 | 0.27 | 0.23 | 2.35 | 0.78 | Zn:0.15 | balance |

TABLE 1(a)-continued

| | Alloy composition | | | | | |
|---|---|---|---|---|---|---|
| | Be | Ni | Co | Al | Other elements | Cu |
| Example 12 | 0.30 | 1.90 | — | 0.56 | Fe:0.25 | balance |
| Example 13 | 0.28 | — | 2.45 | 0.96 | Mg:0.15, Ti:0.10 | balance |
| Example 14 | 0.25 | 2.32 | — | 0.72 | Sn:0.20, Zn:0.10 | balance |

TABLE 1(b)

| | Alloy composition | | | | | |
|---|---|---|---|---|---|---|
| | Be | Ni | Co | Al | Other elements | Cu |
| Comparative Example 1 | 0.15 | — | 1.40 | 0.82 | — | balance |
| Comparative Example 2 | 0.17 | 3.80 | — | 0.90 | — | balance |
| Comparative Example 3 | 0.20 | 2.50 | — | 0.20 | — | balance |
| Comparative Example 4 | 0.25 | 3.05 | — | 1.75 | — | balance |
| Comparative Example 5 | 0.21 | 1.46 | — | 0.70 | — | balance |
| Comparative Example 6 | 0.28 | 2.35 | — | 2.51 | — | balance |
| Comparative Example 7 | 0.31 | — | 2.05 | 1.70 | — | balance |
| Comparative Example 8 | 0.27 | 0.20 | 2.54 | 0.75 | Sn:0.46, Fe:0.21 | balance |
| Comparative Example 10 | 0.21 | 1.90 | — | 0.62 | Si:0.8, Zn:0.42 | balance |
| Comparative Example 11 | Sn:8.2% P:0.12% | | | | | balance |

TABLE 2

| | Stress relaxation property (%) | Tensile strength (kgf/mm$^2$) | Electrical conductivity IACS (%) | Bending formability R/t | | Grain size (μm) |
|---|---|---|---|---|---|---|
| | | | | longi. | trans. | |
| Example 1 | 86 | 78 | 40 | 2.3 | 2.2 | 22 |
| Example 2 | 87 | 80 | 35 | 2.0 | 2.2 | 20 |
| Example 3 | 88 | 81 | 34 | 2.2 | 2.2 | 21 |
| Example 4 | 93 | 84 | 31 | 1.8 | 1.8 | 16 |
| Example 5 | 86 | 80 | 32 | 2.2 | 2.3 | 23 |
| Example 6 | 92 | 87 | 26 | 2.3 | 2.3 | 20 |
| Example 7 | 86 | 82 | 38 | 1.5 | 2.0 | 14 |
| Example 8 | 91 | 83 | 26 | 2.0 | 2.0 | 17 |
| Example 9 | 92 | 84 | 27 | 1.8 | 2.0 | 17 |
| Example 10 | 89 | 82 | 30 | 1.8 | 2.0 | 17 |
| Example 11 | 90 | 80 | 32 | 2.0 | 2.0 | 18 |
| Example 12 | 88 | 81 | 35 | 1.7 | 2.1 | 18 |
| Example 13 | 92 | 84 | 29 | 2.2 | 2.3 | 18 |
| Example 14 | 90 | 83 | 30 | 2.0 | 2.3 | 19 |
| Comparative Example 1 | 68 | 65 | 30 | 4.5 | 4.5 | 45 |
| Example 2 | 72 | 62 | 21 | 2.5 | 2.7 | 30 |
| Example 3 | 79 | 73 | 40 | 2.5 | 2.7 | 18 |
| Example 4 | 80 | 79 | 20 | 2.8 | 3.6 | 28 |
| Example 5 | 75 | 76 | 30 | 3.0 | 4.5 | 40 |
| Example 6 | 77 | 75 | 19 | 3.5 | 4.5 | 45 |
| Example 7 | 81 | 80 | 22 | 2.8 | 4.0 | 30 |
| Example 8 | 83 | 81 | 23 | 2.9 | 3.9 | 28 |
| Example 9 | 82 | 78 | 21 | 3.0 | 4.5 | 30 |
| Example 10 | 80 | 87 | 53 | 2.0 | 2.0 | 13 |
| Example 11 | 20 | 79 | 10 | 1.5 | 7.0 | 10 |

TABLE 3

| | Stress relaxation property (%) | Tensile strength (kgf/mm$^2$) | Electrical conductivity IACS (%) | Bending formability R/t | |
|---|---|---|---|---|---|
| | | | | longi. | trans. |
| Example 1 | 86 | 76 | 41 | 1.6 | 1.3 |
| Example 2 | 86 | 78 | 34 | 1.3 | 1.3 |
| Example 3 | 88 | 79 | 34 | 1.2 | 1.2 |
| Example 4 | 90 | 83 | 30 | 1.0 | 0.8 |
| Example 5 | 85 | 80 | 32 | 1.3 | 1.3 |
| Example 6 | 90 | 85 | 27 | 1.5 | 1.8 |
| Example 7 | 85 | 81 | 36 | 1.1 | 1.0 |
| Example 8 | 89 | 83 | 26 | 1.3 | 1.5 |
| Example 9 | 91 | 82 | 28 | 1.3 | 1.3 |
| Example 10 | 88 | 81 | 30 | 1.2 | 1.4 |
| Example 11 | 88 | 79 | 31 | 1.3 | 1.4 |
| Example 12 | 86 | 80 | 33 | 1.4 | 1.4 |
| Example 13 | 90 | 82 | 28 | 1.4 | 1.6 |
| Example 14 | 89 | 82 | 31 | 1.4 | 1.5 |
| Comparative Example 1 | 67 | 60 | 29 | 3.0 | 3.0 |
| Example 2 | 71 | 60 | 22 | 2.5 | 2.6 |
| Example 3 | 78 | 68 | 39 | 2.0 | 2.0 |
| Example 4 | 79 | 79 | 18 | 2.6 | 3.0 |
| Example 5 | 73 | 75 | 29 | 2.8 | 4.0 |
| Example 6 | 80 | 70 | 19 | 3.0 | 3.0 |
| Example 7 | 78 | 72 | 21 | 2.8 | 3.0 |
| Example 8 | 80 | 75 | 20 | 2.6 | 2.8 |
| Example 9 | 79 | 74 | 20 | 2.5 | 2.5 |
| Example 10 | 78 | 78 | 53 | 1.4 | 1.6 |

TABLE 4

| | Stress relaxation property (%) | Tensile strength (kgf/mm$^2$) | Electrical conductivity IACS (%) | Bending formability R/t | |
|---|---|---|---|---|---|
| | | | | longi. | trans. |
| Example 1 | 88 | 77 | 41 | 1.8 | 2.8 |
| Example 2 | 88 | 80 | 36 | 1.3 | 2.8 |
| Example 3 | 90 | 82 | 34 | 1.4 | 3.0 |
| Example 4 | 91 | 85 | 33 | 1.0 | 3.2 |
| Example 5 | 87 | 82 | 32 | 1.3 | 3.6 |
| Example 6 | 92 | 87 | 28 | 1.5 | 3.9 |
| Example 7 | 88 | 83 | 39 | 1.3 | 3.5 |
| Example 8 | 92 | 82 | 27 | 1.7 | 3.8 |
| Example 9 | 93 | 83 | 28 | 1.7 | 3.8 |
| Example 10 | 90 | 84 | 31 | 1.5 | 3.0 |
| Example 11 | 90 | 82 | 33 | 1.5 | 3.5 |
| Example 12 | 90 | 83 | 36 | 1.7 | 2.9 |
| Example 13 | 92 | 84 | 31 | 2.0 | 3.7 |
| Example 14 | 91 | 85 | 31 | 2.0 | 3.9 |
| Comparative Example 1 | 68 | 60 | 33 | 2.8 | 4.1 |
| Example 2 | 72 | 63 | 20 | 2.8 | 4.5 |
| Example 3 | 80 | 70 | 42 | 2.5 | 4.2 |
| Example 4 | Uncapable of being rolled due to edge cut | | | | |
| Example 5 | 75 | 70 | 22 | 3.0 | 7.5 |
| Example 6 | Uncapable of being rolled due to edge cut | | | | |
| Example 7 | Uncapable of being rolled due to edge cut | | | | |
| Example 8 | 82 | 80 | 24 | 2.7 | 6.0 |
| Example 8 | 87 | 76 | 23 | 3.5 | 6.5 |
| Example 10 | 84 | 84 | 54 | 2.0 | 3.0 |

As is clear from the characteristic values in the above Examples, according to the present invention, as compared with the conventional Cu-Ni-Be base alloy in Comparative alloy No. 10, the Be content is decreased to reduce the material cost, and stress relaxation property is improved while strength is maintained at the same level. Further, as compared with the spring phosphor bronze in Comparative alloy No. 11, the alloys according to the present invention have more excellent stress relaxation property, electrical conductivity and formability. As mentioned above, since the electrically conductive spring materials according to the present invention have more excellent total balance among various characteristics and cost performances. Thus, the alloy according to the present invention greatly contributes to industrial developments as electrically conductive spring materials to sweep off the conventional problems.

What is claimed is:

1. An electrically conductive material consisting essentially of 0.15 to 0.35 wt & of Be, 0.3 to 1.5 wt % of Al, Ni and Co in a total amount of 1.6 to 3.5 wt %, and the balance being Cu with inevitable impurities.

2. An electrically conductive material according to claim 1, wherein the following inequalities are satisfied in terms of weight % ratio;

(a) $(1.75+0.5\times \text{Al content}) \leqq (\text{Ni content}+\text{Co content}) \leqq (2.75+0.5\times \text{Al content})$; and (b) $(2.4-2\times \text{Be content}) \leqq (\text{Ni content}+\text{Co content}) \leqq (3.6-2\times \text{Be content})$.

3. An electrically conductive spring material consisting essentially of 0.15 to 0.35 wt % of Be, 0.3 to 1.5 wt % of Al, Ni and Co in a total amount of 1.6 to 3.5 wt %, at least one element selected from the group consisting of Si, Sn, Zn, Fe, Mg and Ti in a total amount of 0.05 to 1.0 wt %, and in individual amounts of 0.05 to 0.35 wt %, the balance being Cu with inevitable impurities.

4. An electrically conductive spring material according to claim 3, wherein the following inequalities are satisfied in terms of weight % ratio;

(a) $(1.75+0.5\times \text{Al content}) \leqq (\text{Ni content}+\text{Co content}) \leqq (2.75+0.5\times \text{Al content})$; and (b) $(2.4-2\times \text{Be content}) \leqq (\text{Ni content}+\text{Co content}) \leqq (3.6-2\times \text{Be content})$.

* * * * *